US008186824B2

(12) United States Patent
Fujita

(10) Patent No.: US 8,186,824 B2
(45) Date of Patent: May 29, 2012

(54) IMAGE FORMING APPARATUS WITH LEADING-EDGE DETECTION SENSOR

(75) Inventor: Akihiro Fujita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 754 days.

(21) Appl. No.: 12/263,124

(22) Filed: Oct. 31, 2008

(65) Prior Publication Data

US 2009/0122096 A1 May 14, 2009

(30) Foreign Application Priority Data

Nov. 14, 2007 (JP) ..... 2007-295267

(51) Int. Cl.
*B41J 2/01* (2006.01)

(52) U.S. Cl. ..... 347/104; 347/16; 347/101

(58) Field of Classification Search ..... None
See application file for complete search history.

(56) References Cited

U.S. PATENT DOCUMENTS

| | | | | |
|---|---|---|---|---|
| 7,396,123 | B2 * | 7/2008 | Sootome et al. | 347/104 |
| 7,431,422 | B2 | 10/2008 | Asanuma et al. | |
| 2005/0067775 | A1 * | 3/2005 | Ono | 271/272 |
| 2005/0194730 | A1 | 9/2005 | Nishida et al. | |
| 2005/0253323 | A1 | 11/2005 | Fujita et al. | |
| 2005/0265749 | A1 | 12/2005 | Asanuma et al. | |
| 2006/0261544 | A1 * | 11/2006 | Tamura et al. | 271/303 |
| 2008/0122161 | A1 | 5/2008 | Fujita | |

FOREIGN PATENT DOCUMENTS

| | | |
|---|---|---|
| JP | 2002-362775 | 12/2002 |
| JP | 2003-252482 | 9/2003 |
| JP | 2004-122685 | 4/2004 |
| JP | 2005-007799 | 1/2005 |
| JP | 2006-082231 | 3/2006 |
| JP | 2006-082371 | 3/2006 |
| JP | 2007-136769 | 6/2007 |
| JP | 2007-219158 | 8/2007 |

OTHER PUBLICATIONS

Office Action issued Oct. 4, 2011 in Japan Application No. 2007-295267.

* cited by examiner

*Primary Examiner* — Matthew Luu
*Assistant Examiner* — Erica Lin
(74) *Attorney, Agent, or Firm* — Oblon, Spivak, McClelland, Maier & Neustadt, L.L.P.

(57) ABSTRACT

An image forming apparatus including a recording head, a transport belt, a pressure roller, an inlet detection sensor, a leading edge detection sensor, and a control unit. The control unit controls the leading edge of the sheet to stop at the nip portion of the pressure roller and the transport belt based on the detection by the inlet detection sensor. When the leading edge of a sheet is not detected by the leading edge sensor, the leading edge position of the sheet is set based on a stop position at a nip portion of the pressure roller and the transport belt.

14 Claims, 9 Drawing Sheets

IMAGE FORMING APPARATUS WITH LEADING-EDGE DETECTION SENSOR

CROSS-REFERENCE TO RELATED APPLICATIONS

This application is based upon and claims priority under 35 U.S.C. §119 to Japanese Patent Application No. 2007-295267, filed Nov. 14, 2007, the entire contents of which are hereby incorporated by reference.

BACKGROUND OF THE INVENTION

1. Field of the Invention

The present invention generally relates to an image forming apparatus having a recording head for ejecting recording liquid droplets.

2. Description of the Related Art

As for known image forming apparatuses, there are printers, facsimile machines, copiers, plotters, and multi-function machines. One example of such an image forming apparatus is a liquid jet recording apparatus (e.g., inkjet recording apparatus). The liquid jet recording apparatus performs an image forming (also referred to as "recording", "printing" and the like) operation by using a recording head that ejects droplets of ink to a sheet. The liquid jet recording apparatus includes, for example, a serial type image forming apparatus that forms images by ejecting liquid droplets while moving the recording head in a main scanning direction or a line type image forming apparatus that forms images by ejecting liquid droplets without moving the recording head.

It is to be noted that the term "image forming apparatus" includes apparatuses that form images by impacting ink to materials such as paper, string, fiber, fabric, leather, metal, plastic, glass, wood, and ceramic. Furthermore, the term "image formation" not only includes forming images that have a meaning (e.g., letters, shapes) on a medium but also includes forming images having no particular meaning (e.g., patterns. i.e., liquid droplets are just impacted to a medium). Furthermore, the term "ink" not only includes so-called ink, but also includes any liquid which can be used to form images (e.g., recording liquid, fixing liquid, etc.). Furthermore, the term "sheet" not only includes paper, but also includes any materials onto which ink droplets can adhere (e.g., sheet for overhead projector, fabric, so-called recording medium or recording sheet and the like).

In such image forming apparatuses, a sheet detection sensor is provided so as to detect a leading edge of a sheet or a position of a sheet with respect to a direction along the width of the sheet. A blank space (nonprintable area) in the trailing edge of the sheet is determined based on the sheet size and the position of the leading edge of the sheet detected by the sheet detection sensor. In other words, an area for image forming is determined.

In apparatuses using a belt as a sheet transportation unit, it is difficult to use a mechanical switch or a transmissive photo sensor in order to detect a leading edge of a sheet because the sheet is placed and transported on the belt. As a technique concerning this, Japanese Patent Laid-Open Publication No. 2006-082231 (Patent Document 1) and 2005-007799 (Patent Document 2) disclose that a reflective photo sensor is used so as to detect a sheet. In apparatuses of an electrophotographic system, Japanese Patent Laid-Open Publication No. 2002-362775 (Patent Document 3) is related.

However, in some kinds of sheets, a reflected light of the sheet for incident light from a reflective photo sensor is not so different from a reflected light of the surface of the belt (e.g., sheet for overhead projector, thin paper, colored paper). In such sheets, it is not able to detect a leading edge of the sheet correctly by a reflective photo sensor.

Therefore, if such a reflective photo sensor mentioned in Patent Document 1 or 2 is used, an image forming area of the sheet (i.e., blank space in a leading edge or a trailing edge) is not determined correctly based on a leading edge position detected by the reflective photo sensor. Because of this, liquid droplets are ejected on the belt and it causes a problem that a surface of a following sheet is stained by the liquid deposited on the belt.

SUMMARY OF THE INVENTION

The present invention has been made in view of the above-mentioned circumstances.

It is an object of the present invention to at least partially solve the problems in the conventional technology.

An image forming apparatus according to an exemplary embodiment of the present invention includes a recording head that ejects liquid droplets to a sheet, a transport belt that is extended around at least two rollers and transports the sheet facing the recording head, a pressure roller that corresponds to a upstream side roller among the two rollers with respect to the sheet transport direction and presses the sheet against the transport belt, an inlet detection sensor that detects the sheet in upstream side of a nip of the pressure roller and the transport belt with respect to the sheet transport direction, a leading edge detection sensor that detects a leading edge of the sheet in downstream side of a nip of the pressure roller and the transport belt with respect to the sheet transport direction, and a control unit that controls the leading edge of the sheet to stop at the nip portion of the pressure roller and the transport belt based on the detection by the inlet detection sensor. Wherein, in the case of that the leading edge of the sheet is not detected by the leading edge sensor, the leading edge position of the sheet is determined based on the stop position at the nip portion of the pressure roller and the transport belt.

In another exemplary embodiment, an image forming apparatus includes a recording head that ejects liquid droplets to a sheet, a transport belt that is extended around at least two rollers and transports the sheet facing the recording head, a pressure roller that corresponds to a upstream side roller among the two rollers with respect to the sheet transport direction and presses the sheet against the transport belt, an inlet detection sensor that detects the sheet in upstream side of a nip of the pressure roller and the transport belt with respect to the sheet transport direction, a leading edge detection sensor that detects a leading edge of the sheet in downstream side of a nip of the pressure roller and the transport belt with respect to the sheet transport direction, and a control unit that controls the leading edge of the sheet to stop at the nip portion of the pressure roller and the transport belt based on the detection by the inlet detection sensor. Wherein in the case of that the sheet is not detected in a predetermined time by the leading edge sensor moved at a position for detecting the leading edge, the leading edge position of the sheet is determined based on the stop position at the nip portion of the pressure roller and the transport belt.

According to the above-described image forming apparatus, it is possible to determine a blank space within the trailing edge of a sheet even if the leading edge of the sheet is not detected by a leading edge detection sensor.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF THE PREFERRED EMBODIMENTS

Figure 1:
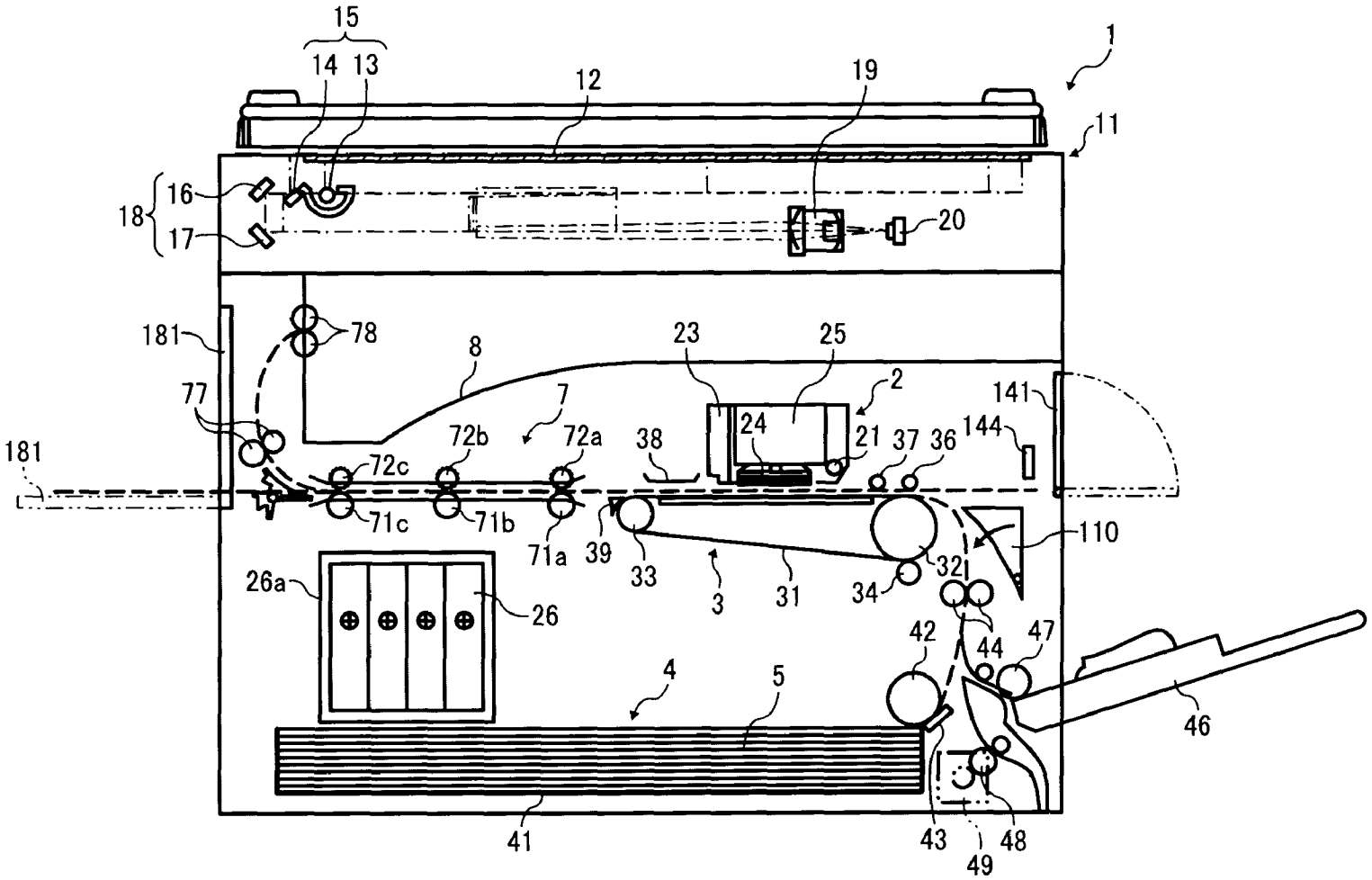
FIG. 1 is a schematic diagram illustrating a configuration of an image forming apparatus according to an embodiment of the present invention.
Figure 2:
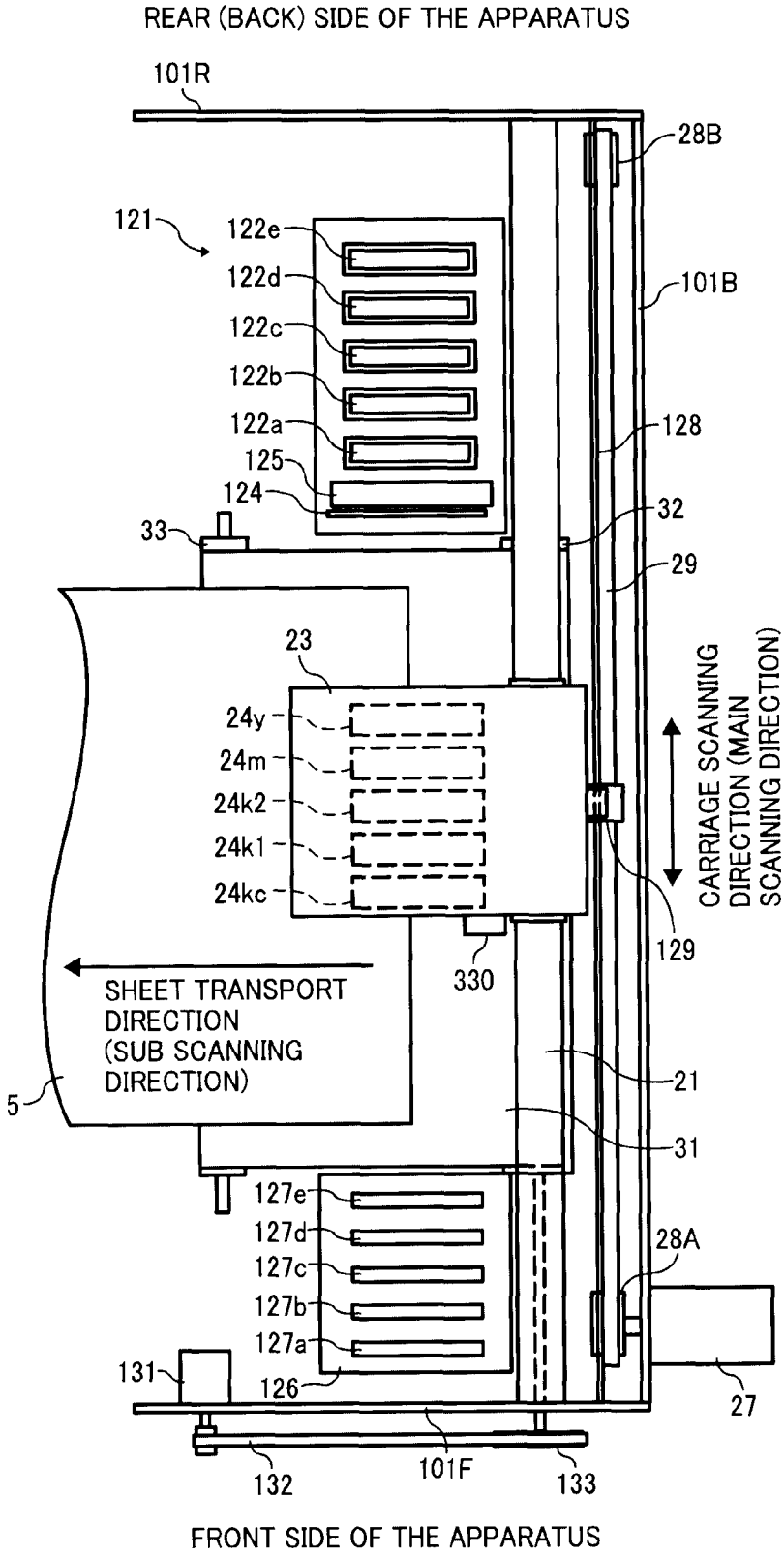
FIG. 2 is a plane view illustrating an image forming unit and a sub scanning direction transport unit of the image forming apparatus of FIG. 1.
Figure 3:
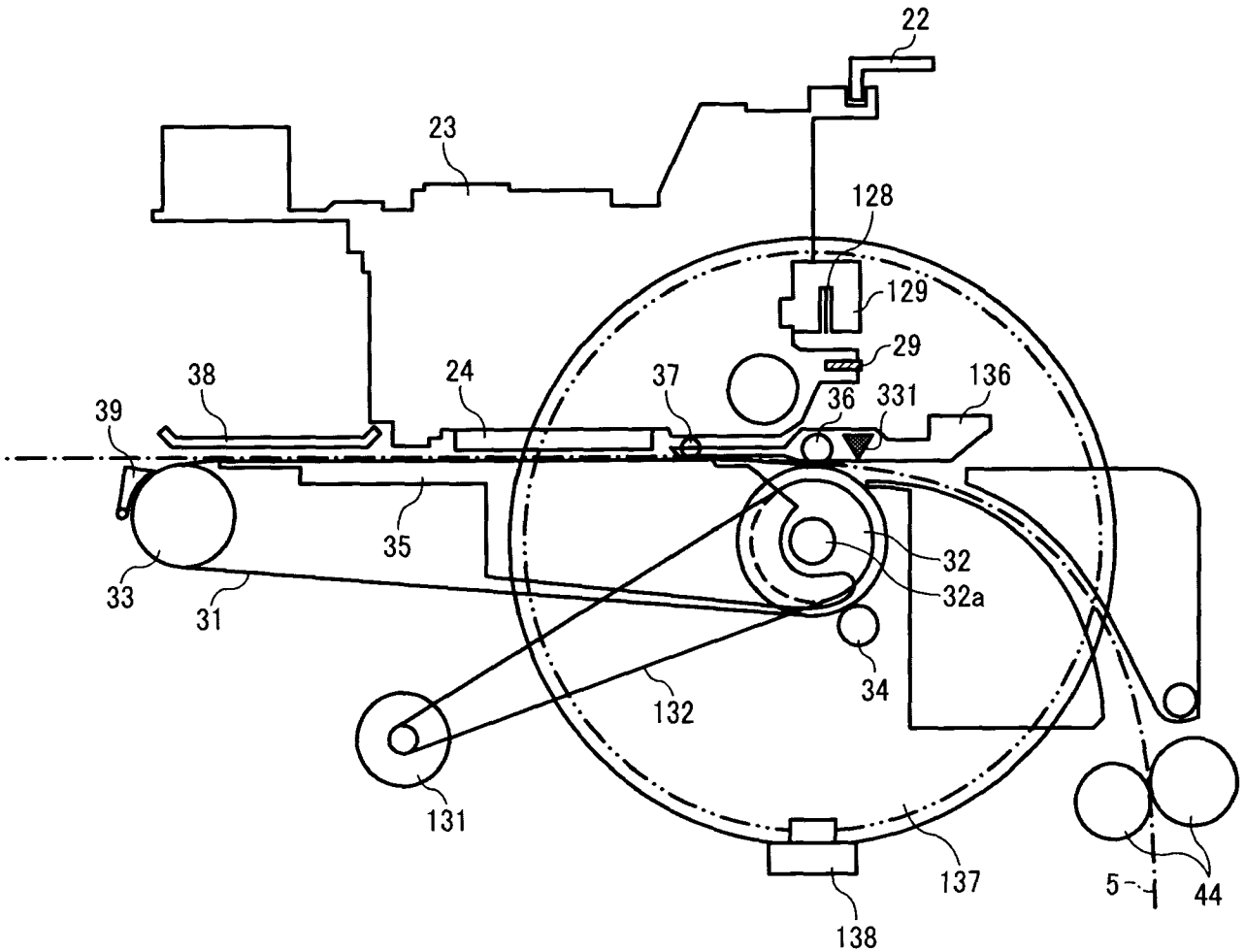
FIG. 3 is a cut-away front view illustrating the image forming apparatus of FIG. 1.

Preferred embodiments of the present invention are described hereinafter with reference to the accompanying drawings. An image forming apparatus of an embodiment of the present invention is described below with reference to FIGS. 1 through 3. FIG. 1 schematically illustrates a configuration of the image forming apparatus. FIG. 2 is a plan view illustrating an image forming unit 2 and a sub scanning direction transport unit 3 of the image forming apparatus. FIG. 3 is a side view illustrating the image forming apparatus.

The image forming apparatus includes, in an apparatus main body 1, the image forming unit 2 that forms an image on a sheet (or other recording medium) 5 and the sub scanning direction transport unit 3 that transports the sheet 5. In the image forming apparatus, sheets 5 are fed one by one from a sheet feed unit 4 including a sheet cassette 41 disposed at the bottom of the apparatus main body 1. The sheet 5 is transported by the sub scanning direction transport unit 3 to a position facing the image forming unit 2, where an image is formed (recorded) on the sheet 5 by liquid droplets ejected from the image forming unit 2. Then the sheet 5 is ejected by a sheet ejection/transport unit 7 onto a sheet ejection tray 8 disposed at the upper side of the apparatus main body 1.

The image forming apparatus further includes an image reading unit (scanner unit) 11 disposed above the sheet ejection tray 8 in the apparatus main body 1 and is configured to read images. The image reading unit 11 serves as an image data (print data) input unit for reading image data, based on which an image is formed by the image forming unit 2. In the image reading unit 11, an image of the original document placed on a contact glass 12 is scanned by moving a first scanning optical unit 15, including a light source 13 and a mirror 14, and a second scanning optical unit 18, including mirrors 16 and 17. The scanned image of the original document is read as image signals by an image reading element 20 disposed behind a lens 19. The read image signals are digitized and processed into print data to be printed out.

With reference to FIG. 2, in the image forming unit 2 of the image forming apparatus, a carriage 23 is movable in the main scanning direction and is held by a carriage guide (guide rod) 21 as the main guide member, extending between a front side panel 101F and a rear side panel 101R, and a guide stay 22 as a sub guide member, disposed at the side of a rear stay 101B. The carriage 23 is moved in the main scanning direction by a main scanning motor 27 via a timing belt 29 extending around a drive pulley 28A and a driven pulley 28B.

In the carriage 23 a total of five recording heads (liquid ejection heads) 24 are mounted, namely, recording heads 24*k*1 and 24*k*2 for ejecting black (K) ink, a recording head 24*kc* for cyan (C) ink, a recording head 24*m* for magenta (M) ink, and a recording head 24*y* for yellow (Y) ink. These recording heads 24*k*1, 24K2, 24*kc*, 24*m*, and 24*y* may be referred to as the recording heads 24 when the colors thereof are not referred to. The image forming unit 2 is a shuttle type, which reciprocally moves the carriage 23 in the main scanning direction while ejecting liquid droplets from the recording heads 24 to form an image on the sheet 5 being transported in a sheet transport direction (the sub scanning direction) by the sub scanning direction transport unit 3.

On the carriage 23 are also mounted sub tanks 25 (FIG. 1) that supply color recording liquids to the corresponding recording heads 24. Referring back to FIG. 1, ink cartridges 26 respectively storing black (K) ink, cyan (C) ink, magenta (M) ink, and yellow (Y) ink are detachably attached to a cartridge attachment section 26A from the front side of the apparatus main body 1. The inks (recording liquids) in the ink cartridges 26 are supplied to the corresponding sub tanks 25. The black ink is supplied from the black ink cartridge 26 to the two black sub tanks 25.

The recording head 24 may be a piezo type that includes a pressure generating unit (actuator unit), which is used for applying pressure to ink in an ink passage (pressure generating chamber) and is configured to deform a wall of the ink passage so as to change the volume of the ink passage, thereby ejecting ink droplet. The recording head 24 may also be a thermal type configured to heat the ink in an ink passage using a heating element so as to form bubbles, thereby ejecting the ink with the pressure of the bubbles. The recording head 24 could also be an electrostatic type that includes a diaphragm on a wall of an ink passage and an electrode opposing the diaphragm, and is configured to deform the diaphragm with static electricity between the diaphragm and the electrode so as to change the volume of the ink passage, thereby ejecting ink droplets.

A linear scale 128 is disposed that extends between the front side panel 101F and the rear side panel 101R in the main scanning direction of the carriage 23. The carriage 23 is provided with an encoder sensor 129 including a transmissive photo sensor for detecting slits of the linear scale 128. The linear scale 128 and the encoder sensor 129 constitute a linear encoder that detects movement of the carriage 23.

Figure 5:
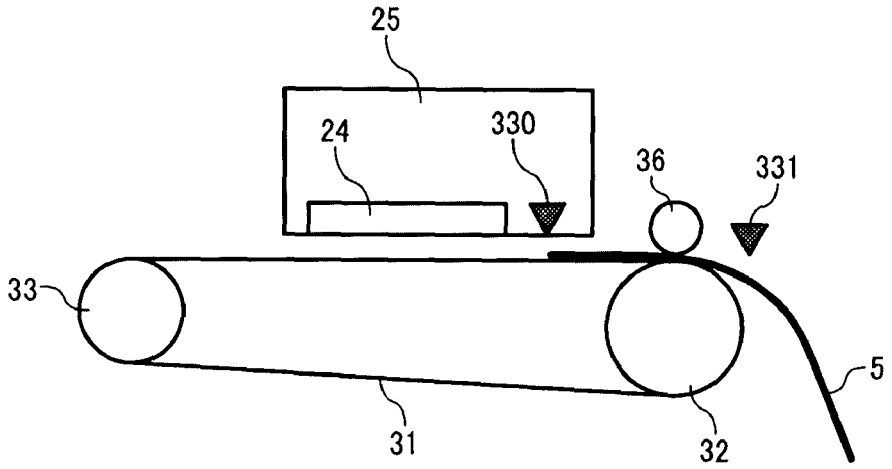
FIG. 5 is a schematic diagram for explaining a detecting operation of a leading edge by a leading edge detection sensor in the image forming apparatus of FIG. 1.

As shown in FIG. 5, on one side of the carriage 23 is disposed a leading edge detection sensor 330 that detects a leading edge of the sheet 5. More specifically, the leading edge detection sensor 330 detects the sheet 5 on a side downstream from a nip of an endless transport belt 31 and a pressure roller 36 with respect to the sheet transport direction.

A maintenance recovery mechanism (device) 121 for maintaining and restoring the condition of nozzles of the recording head 24 is provided in a non-printing region at one side in the scanning direction of the carriage 23. The maintenance recovery mechanism 121 includes one suction cap 122*a*, serving also as a dry-proof cap, and four dry-proof caps 122*b* through 122*e* for capping nozzle faces of the five recording heads 24. The maintenance recovery mechanism 121 further includes a wiper blade 124 for wiping the nozzle faces of the recording heads 24, and an idle ejection receiver 125 for idle ejection. Another idle ejection receiver 126 for idle ejection is disposed in a non-printing region at the opposite side from the maintenance recovery mechanism 121 in the scanning direction of the carriage 23. The idle ejection receiver 126 includes openings 127*a* through 127*e*.

Referring also to FIG. 3, the sub scanning direction transport unit 3 includes a transport roller 32 which is a drive roller that changes a transport direction of the sheet 5 fed from the lower side by 90 degrees such that the sheet 5 is transported in a manner facing the image forming unit 2, a driven roller 33 which is a tension roller, the transport belt 31 extending around the transport roller 32 and the driven roller 33, a charging roller 34 which is a charger that charges the surface of the transport belt 31 with a high voltage (alternating current) from a high-voltage power supply, a guide member 35 that guides the transport belt 31 within an area opposing the image forming unit 2, pressure rollers 36 and 37 rotatably supported by a support member 136 which are configured to press the sheet 5 against the transport belt 31 at a position opposing the transport roller 32, a guide plate 38 that presses on the upper surface of the sheet 5 on which images are formed by the image forming unit 2, and a separation claw 39 that separates the sheet 5 on which images are formed from the transport belt 31. Furthermore, as shown in FIG. 5, an inlet detection sensor 331 is disposed at a side upstream from the nip of the transport belt 31 and the pressure roller 36 with respect to the sheet transport direction, so as to detect the sheet 5.

The transport belt 31 is rotated to transport the sheet 5 in the sheet transport direction (sub scanning direction) when the transport roller 32 is rotated through a timing belt 132 and a timing roller 133 by a sub scanning motor 131 using a DC brushless motor.

A code wheel 137 of high resolution is attached to a shaft 32*a* of the transport roller 32. An encoder sensor 138 including a transmissive photo sensor for detecting slits (not shown) formed in the code wheel 137. The code wheel 137 and the encoder sensor 138 form a rotary encoder.

The sheet feed unit 4 includes the sheet cassette 41 that is removable from the apparatus main body 1 and capable of stacking and storing a large number of sheets 5 therein, a sheet feed roller 42 and a friction pad 43 for feeding the sheets 5 one by one, and a pair of registration rollers 44 for registration of the transported sheet 5.

The sheet feed unit 4 includes a manual sheet feed tray 46 capable of stacking and storing a large number of sheets 5 therein, a manual sheet feed roller 47 that feeds the sheets 5 one by one from the manual sheet feed tray 46, a vertical transport roller 48 that transports the sheets 5 fed from another sheet feed cassette (not shown), which can be optionally attached to the lower side of the apparatus main body 1 and from a duplex print unit (not shown). Rollers for feeding the sheet 5 to the sub scanning direction transport unit 3, such as the sheet feed roller 42, the pair of registration rollers 44, the manual sheet feed roller 47, and the vertical transport roller 48, are driven by a sheet feed motor 49, which is an HB stepping motor, via an electromagnetic clutch (not shown).

The sheet ejection/transport unit 7 includes three transport rollers 71*a*, 71*b*, and 71*c* (also referred to as transport rollers 71) that transport the sheet 5 separated by the separation claw 39 of the sub scanning direction transport unit 3; three spurs 72*a*, 72*b*, and 72*c* (also referred to as spurs 72) facing transport rollers 71*a*, 71*b*, and 71*c*, respectively; a pair of reverse rollers 77 for reversing the sheet 5; and a pair of reverse/ejection rollers 78 for outputting the sheet 5 with its face down onto the sheet ejection tray 8.

As shown in FIG. 1, in the image forming apparatus, a single sheet manual feed tray 141 for manually feeding a single sheet is rotatably attached to one side of the apparatus main body 1. When manually feeding a single sheet, the single sheet manual feed tray 141 is rotated to an open position indicated by a double-dot chain line. The sheet 5 that has been manually fed from the single sheet manual feed tray 141 is guided by the upper surface of a guide plate 110 to be inserted straight between the transport roller 32 and the pressure roller 36 of the sub scanning direction transport unit 3.

A straight ejection tray 181 to which a sheet 5 having an image formed thereon is ejected with its face up is rotatably attached to the other side of the apparatus main body 1. When the straight ejection tray 181 is rotated to an open position indicated by a double-dot chain line, the sheet 5 transported by the sheet ejection/transport unit 7 can be output straight to the straight ejection tray 181.

Figure 4:
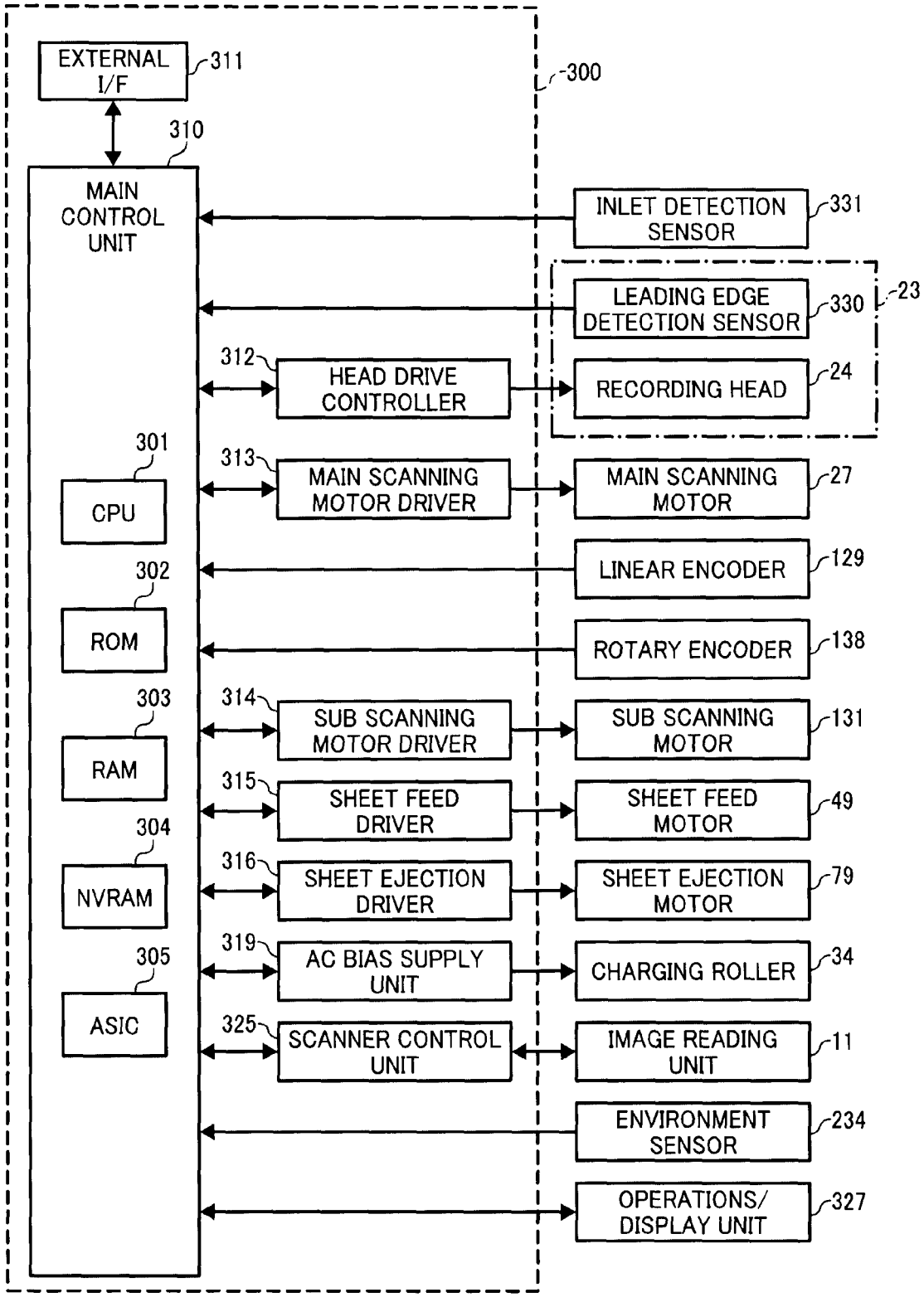
FIG. 4 is a block diagram illustrating a control unit of the image forming apparatus of FIG. 1.

The following describes an overview of a control unit 300 of the image forming apparatus with reference to FIG. 4.

The control unit 300 includes a main control unit 310 that controls the entire operation of the image forming apparatus and controls formation of an adjustment pattern, detection of an adjustment pattern, and adjustment (correction) of an impact position. The main control unit 310 includes a CPU 301, a ROM 302 that stores programs to be executed by the CPU 301 and other fixed data, a RAM 303 that temporarily stores image data, etc., a nonvolatile memory (NVRAM) 304 that retains data even when power is removed, and an ASIC 305 that processes input/output signals for processing images such as sorting and for controlling the apparatus.

The control unit 300 further includes an external I/F 311 through which signals and data are transmitted to a host device from the main control unit 310 and to the host device from the main control unit 310; a head drive controller 312 including a head driver (actually attached to the side of the recording heads 24) that controls and drives the recording heads 24 and includes an ASIC for head data generation sequence conversion; a main scanning motor driver 313 that drives the main scanning motor 27 for moving the carriage 23; a sub scanning motor driver 314 that drives the sub scanning motor 131; a sheet feed driver 315 that drives the sheet feed motor 49; a sub scanning motor driver 314 that drives the sub scanning motor 131; a sheet feed driver 315 that drives the sheet feed motor 49; a sheet ejection driver 316 that drives a sheet ejection motor 79 for driving the rollers of the sheet ejection/transport unit 7; an AC bias supply unit 319 that supplies an AC bias to the charging roller 34; a maintenance recovery system driver (not shown) that drives a maintenance recovery motor (not shown) for driving the maintenance recovery mechanism 121; a duplexing unit driver (not shown) that drives a duplexing unit when the duplexing unit is attached; a solenoid driver (not shown) that drives various solenoids (SOLs); a clutch driver (not shown) that drives electromagnetic clutches (not shown); and a scanner control unit 325 that controls the image reading unit 11.

The main control unit 310 receives various detection signals, such as signals from the leading edge detection sensor 330 disposed on the carriage 23, signals from the inlet detection sensor 331, signals indicating the temperature and humidity (environmental conditions) around the transport belt 31 from an environment sensor 234. The main control unit 310 receives detection signals from various other sensors (not shown). The main control unit 310 receives instructions entered through various keys, such as numeric keys and a print start key, disposed on the apparatus main body 1. The main control unit 310 also receives instructions entered through an operations/display unit 327 and outputs information to be displayed to the operations/display unit 327.

The main control unit 310 also receives an output signal from the photo sensor (encoder sensor) 129 of the linear encoder for detecting the position of the carriage 23, and controls the main scanning motor 27 through the main scanning motor driver 313 according to the output signal so as to reciprocate the carriage 23 in the main scanning direction. The main control unit 310 also receives an output signal (pulse) from the photo sensor (encoder sensor) 138 of the rotary encoder for detecting the amount of the rotation of the transport belt 31, and controls the sub scanning motor 131 through the sub scanning motor driver 314 according to the output signal so as to rotate the transport belt 31 via the transport roller 32.

An image forming operation by the image forming apparatus having the above-described configuration is briefly described below. The amount of rotation of the transport roller 32, which drives the transport belt 31, is detected. According to the detected amount of rotation, the sub scanning motor 131 is controlled. The AC bias supply unit 319 applies a bipolar rectangular-wave high voltage as an alternating voltage to the charging roller 34. Thus, the transport belt 31 is alternately positively and negatively charged at predetermined widths in the transport direction of the transport belt 31, thereby forming a non-uniform electric field on the transport belt 31.

When the sheet 5 sent from the sheet feed unit 4 passes through between the transport roller 32 and the first pressure roller 36 onto the transport belt 31 on which the non-uniform electric field is generated by positive and negative charges, the sheet 5 is instantaneously polarized along a direction of the electric field and is adhered onto the transport belt 31 due to an electrostatic attraction force. Thus, the sheet 5 is transported along with the movement of the transport belt 31.

The sheet 5 is intermittently transported by the transport belt 31. The carriage 23 is moved in the main scanning direction so as to record (print) images on the non-moving sheet 5 by ejecting droplets of recording liquids from the recording heads 24. The separation claw 39 separates the leading edge of the printed sheet 5 from the transport belt 31 to transport the sheet 5 to the sheet ejection/transport unit 7, by which the sheet 5 is ejected to the sheet ejection tray 8.

The carriage 23 is moved to the side of the maintenance recovery mechanism 121 while standing by for a print (recording) operation. The nozzle faces of the recording heads 24 are capped by the caps 122, used for keeping the nozzles wet, thereby preventing poor ejection due to ink dryout. A recovery operation is performed for ejecting thickened recording liquid and bubbles by suctioning the recording liquid from the nozzles of the recording heads 24 capped by the suction cap 122*a* and the dry-proof caps 122*b*-122*e*. The wiper blade 124 wipes the nozzle faces of the recording heads 24 to remove the ink adhering to the nozzle faces. Further, before starting a recording operation or during a recording operation, idle ejection is performed for ejecting ink to the idle ejection receiver 125 and not for forming images. The idle ejection enables the recording heads 24 to maintain stable ejection performance.

Figure 6:
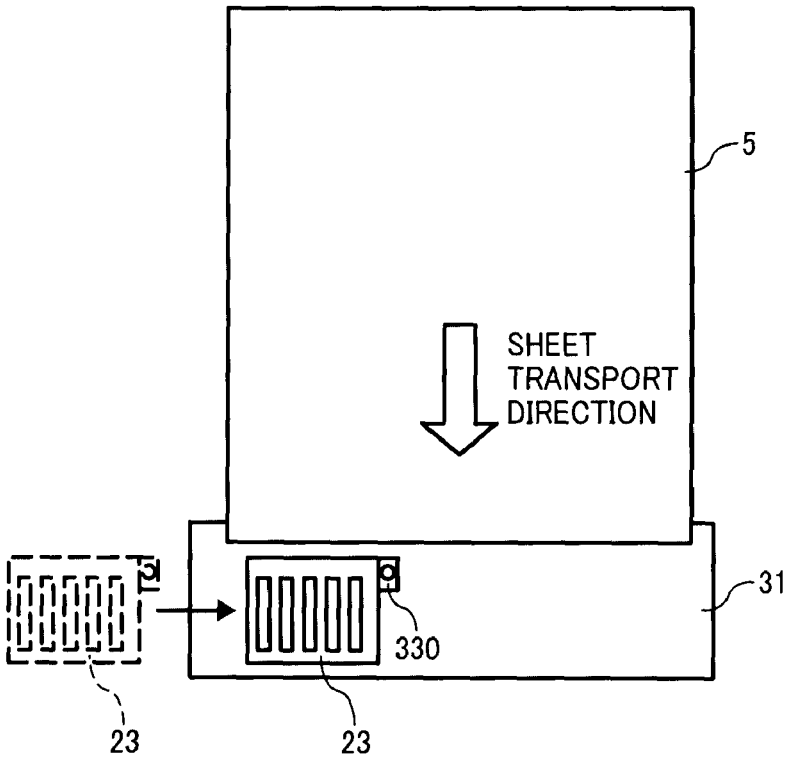
FIG. 6 is a plane view for explaining a detecting operation of a leading edge by a leading edge detection sensor in the image forming apparatus of FIG. 1.

The following describes a detecting operation of a leading edge by the leading edge detection sensor 330 in the image forming apparatus with reference to FIG. 6.

As shown in FIG. 6, the carriage 23 is moved from a home position (the position shown by a dashed line in FIG. 6) to a predetermined position with respect to the main scanning direction (the position shown by a solid line in FIG. 6). The leading edge detection sensor 330 detects the sheet 5 transported by the transport belt 31 and the position is set as a leading edge position. A blank space in the trailing edge of the sheet 5 is determined based on the leading edge position and a preliminarily input sheet size (length of the sheet with respect to sheet transport direction).

Figure 7:
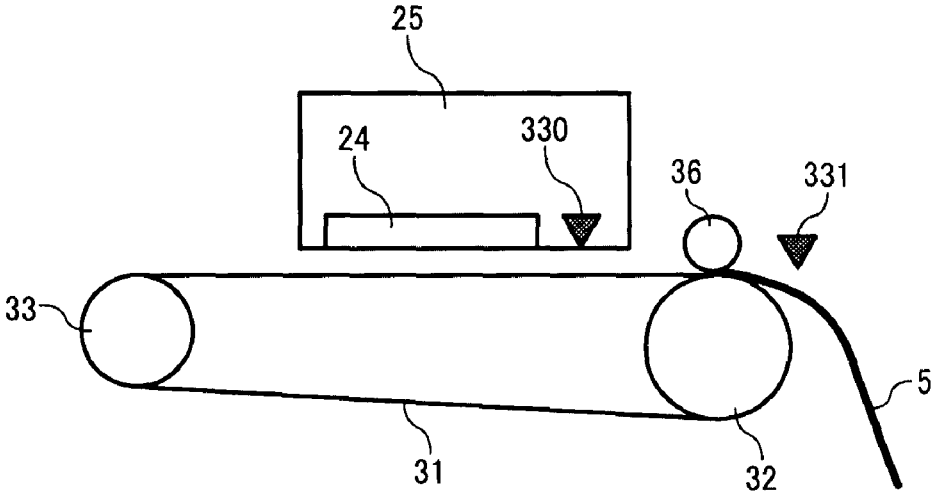
FIG. 7 is a schematic diagram for explaining a detecting operation of a leading edge by an inlet detection sensor in the image forming apparatus of FIG. 1.

The following describes a detecting operation of a leading edge by the inlet detection sensor 331 in the image forming apparatus with reference to FIG. 7.

When the sheet 5 is fed from the sheet feed unit 4 toward the sub scanning direction transport unit 3, the inlet detection sensor 331 detects a leading edge of the sheet 5. The sheet 5 is transported a predetermined amount from when the inlet detection sensor 331 detects the leading edge of the sheet 5 and stopped at a nip portion of the transport belt 31 and the pressure roller 36. The predetermined amount corresponds to an amount in which a required amount, which is determined preliminarily to form an arc in the paper to prevent the paper from being skewed, is added to a distance between the nip portion of the transport belt 31 and the pressure roller 36 and the inlet detection sensor 331. The stop control is able to apply similarly to the detecting operation of a leading edge by the leading edge detection sensor 330.

The position where the sheet 5 is transported the required amount after sheet 5 stopped at a nip portion of the transport belt 31 and the pressure roller 36 is set as a leading edge position. A blank space in the trailing edge of the sheet 5 is determined based on the leading edge position and a preliminarily input sheet size.

In this detecting operation of a leading edge by the inlet detection sensor 331, the stop position of the leading edge of the sheet 5 at the nip portion of the transport belt 31 and the pressure roller 36 varies due to a thickness or rigidity of the sheet 5 even though the sheet 5 is transported the predetermined amount from the detection by the inlet detection sensor 331.

Figure 8A:
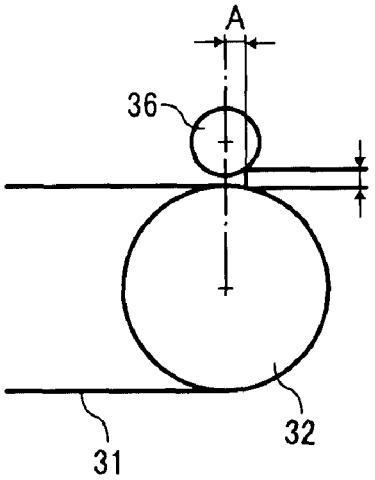
FIGS. 8A and 8B are diagrams for explaining variations of the leading edge detection.
Figure 8B:
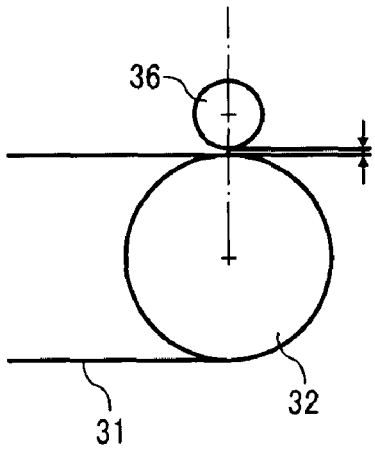

An example of a case in which the thickness of the sheet 5 is t1 or t2 is shown below (t1>t2) with reference to FIGS. 8A and 8B. As shown in FIG. 8B, in case the thickness of the sheet 5 is t2, the sheet 5 is transported to the center of the nip portion of the transport belt 31 and the pressure roller 36 (the position is on line connecting a center of the transport roller 32 and a center of the pressure roller 36). Meanwhile, as shown in FIG. 8A, in case the thickness of the sheet 5 is t1, the sheet 5 is not transported to the center of the nip portion of the transport belt 31 and the pressure roller 36, but is stopped upstream of the nip portion and is a distance A away from the center. Therefore, the leading edge position detected by the inlet detection sensor 331 varies.

Figure 9:
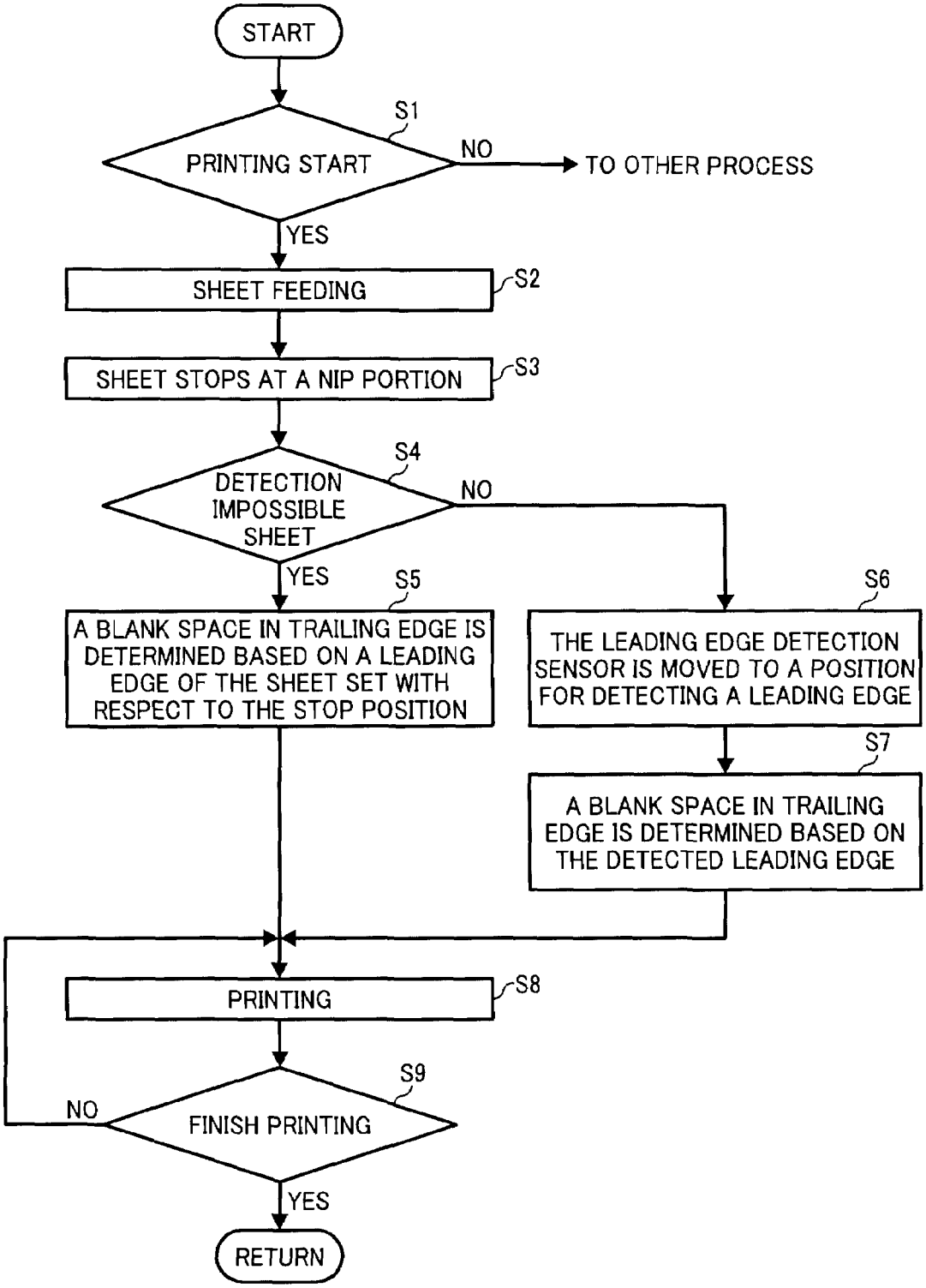
FIG. 9 is a flow diagram for explaining an embodiment of a processing operation including controlling detection of the leading edge of a sheet by the control unit.

The following embodiment of the present invention describes processing including controlling detection of a leading edge of a sheet by the control unit 300 with reference to a flow diagram shown in FIG. 9.

When printing starts in step S1, the sheet 5 is first fed from the sheet feed unit 4 or the manual sheet feed tray 46 or the single sheet manual feed tray 141, see step S2. Then the inlet detection sensor 331 detects the leading edge of the sheet 5, and the sheet 5 is transported a required time or amount so as to form a predetermined amount of arc in the sheet 5 after the detection. At step S3, the sheet 5 is stopped when the leading edge of the sheet 5 contacts the nip portion of the transport belt 31 and the pressure roller 36.

In step S4, the sheet 5 is transported in the sub scanning direction and it is determined whether the sheet 5 is a sheet in which the leading edge is unable to be detected by the leading edge detection sensor 330 (detection impossible sheet) or not. A sheet that is unable to have the leading edge detected is a sheet type in which incident light reflected from the leading edge of the sheet detected by the leading edge detection sensor 330 is substantially the same (same level) as reflected light from the surface of the transport belt 31 (e.g., a sheet for an overhead projector, thin paper, colored paper). It is also possible to preliminarily input whether the sheet 5 is a detection impossible sheet or not from the operations/display unit 327. Alternatively, it is able to determine whether the sheet is a detection impossible sheet by detecting the sheet during transportation. Alternatively, it is also possible to receive the information from a host information-processing device. Furthermore, it is also possible to receive the sheet size in a similar manner.

If the sheet 5 is not the detection impossible sheet, the leading edge detection sensor 330 is moved to a position that detects the leading edge of the sheet 5 by moving of the carriage 23, see Step S6. Then the leading edge detection sensor 330 detects the leading edge of the sheet 5, and a blank space in the trailing edge of the sheet 5 is determined based on the detected leading edge position and the sheet size, see Step S7.

On the other hand, if the sheet 5 is the detection impossible sheet, the leading edge of the sheet 5 is determined with respect to a stop position of the sheet at the nip portion of the transport belt 31 and the pressure roller 36. A blank space in the trailing edge of the sheet 5 is determined based on the determined leading edge position and the sheet size.

As described above, in the detection with respect to a stop position of the sheet, variation of the stop position occurs. Therefore, the blank space in the trailing edge is set to be larger than the blank space set based on the leading edge detected by the leading edge detection sensor 330. For example, in the leading edge detection sensor 330, the blank space in the trailing edge is set to 4 mm. Meanwhile, in the stop position of the sheet, the blank space in the trailing edge is set to 5 mm. This makes it possible to prevent an image that protrudes from the trailing edge of the sheet due to variation of the stop position.

After that, a predetermined amount from the leading edge position is set as a blank space in the leading edge of the sheet 5. In step S8, print processing which forms an image is performed from the blank space in the leading edge to a trailing edge for image forming, which corresponds to the blank space in the trailing edge. The printing is finished in Step S9.

As described above, when a leading edge of a sheet is not able to be detected by the leading edge detection sensor 330, the leading edge of the sheet is determined with respect to a stop position of the sheet at the nip portion of the transport belt 31 and the pressure roller 36. Therefore, a blank space in the trailing edge of the sheet is able to be determined even if the leading edge of the sheet is not able to be detected by the leading edge detection sensor 330. This makes it possible to prevent an image from being formed that overflows the trailing edge of the sheet (i.e., ink droplets contacting the transport belt).

Figure 10:
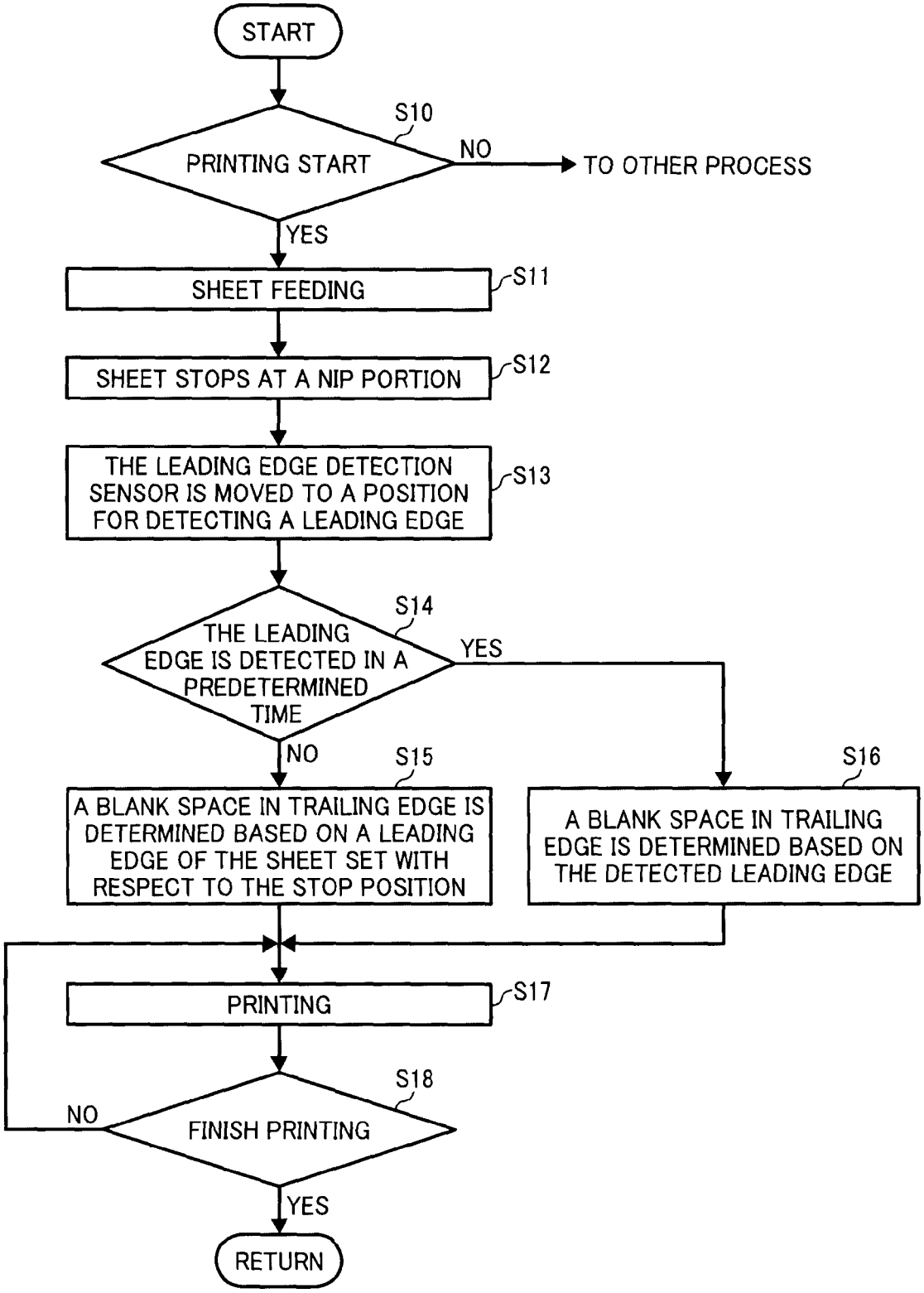
FIG. 10 is a flow diagram for explaining an embodiment of a processing operation including controlling detection of the leading edge of a sheet by the control unit.

The following embodiment of the present invention describes processing including controlling the detection of the leading edge of the sheet by the control unit 300 with reference to the flow diagram of FIG. 10.

When printing starts in step S10, the sheet 5 is first fed from the sheet feed unit 4, the manual sheet feed tray 46, or the single sheet manual feed tray 141, see step S11. Then, the inlet detection sensor 331 detects the leading edge of the sheet 5, and the sheet 5 is transported for a required time or amount so as to form a predetermined amount of arc in the sheet 5 after the detection. In step S12, the sheet 5 is stopped in a place where the leading edge of the sheet 5 contacts the nip portion of the transport belt 31 and the pressure roller 36.

Then, the sheet 5 is transported in the sub scanning direction. In step S13 (or while the sheet 5 is transported), the leading edge detection sensor 330 is moved to a position that detects the leading edge by moving the carriage 23. In step S14, it is determined whether the leading edge detection sensor 330 detects the leading edge of the sheet 5 in a predetermined time.

When the leading edge is detected in the predetermined time by the leading edge detection sensor 330, a blank space in the trailing edge of the sheet 5 is determined based on the detected leading edge position and the sheet size, see step S16.

Meanwhile, if the leading edge is not detected in the predetermined time by the leading edge detection sensor 330, the sheet 5 is assumed to be a sheet in which the leading edge can not be detected (detection impossible sheet), see step S15. The leading edge of the sheet 5 is determined with respect to the stop position, and a blank space in the trailing edge of the sheet 5 is determined based on the determined leading edge position and the sheet size. In addition, as described above, it is better that the amount of the blank space in the trailing edge of the sheet 5 is larger than an amount of blank space in the leading edge of the sheet 5.

After that, a predetermined amount from the leading edge position is determined as a blank space in the leading edge of the sheet 5. In step S17, a printing process which forms an image is performed from the blank space in the leading edge to a trailing edge for image forming, which corresponds to the blank space in the trailing edge. Printing is finished at step S18.

As described above, when a sheet is not detected in the predetermined time after moving the leading edge detection sensor 330 to the detecting position of the leading edge, the leading edge of the sheet is determined with respect to a stop position of the sheet at the nip portion of the transport belt 31 and the pressure roller 36. Therefore, a blank space in the trailing edge is able to be determined even when the leading edge of the sheet is not able to be detected by the leading edge detection sensor 330. This makes it possible to prevent an image that is formed from overflowing the trailing edge of the sheet (i.e., ink droplets contacting the transport belt).

Figure 11:
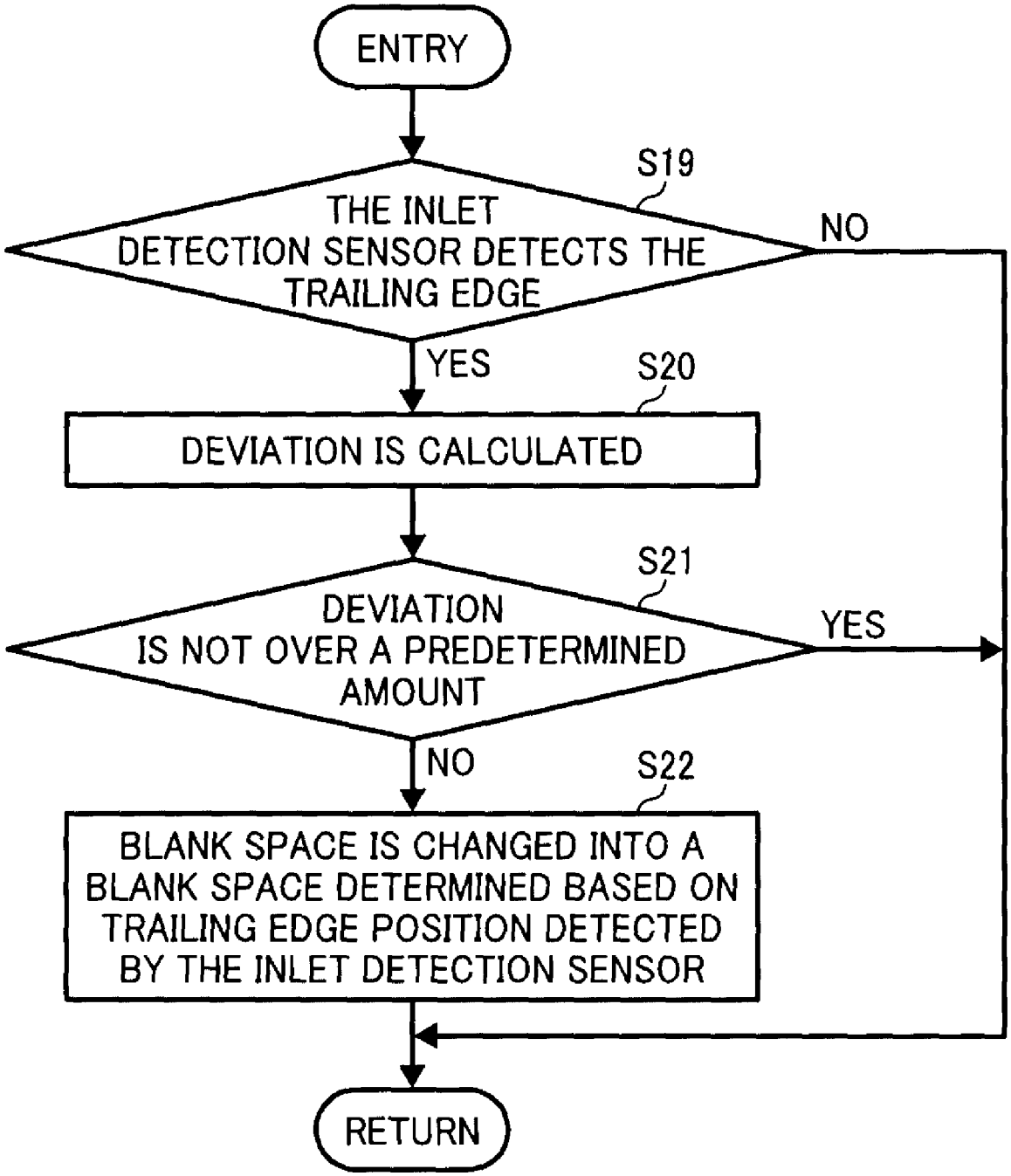
FIG. 11 is a flow diagram for explaining an embodiment of a processing operation including a controlling detection of the leading edge of a sheet by the control unit.

The following describes controlling an amount of blank space in the trailing edge of a sheet by the control unit 300 in an embodiment of the present invention with reference to a flow diagram shown in FIG. 11.

In this embodiment, in step S19, it is determined whether the inlet detection sensor 331 detects the trailing edge of the sheet 5 while printing. When the inlet detection sensor 331 detects the trailing edge, a difference is calculated between the first leading edge position, which is determined based on the leading edge of the sheet and the sheet size, and the second leading edge position, which is obtained by detecting the trailing edge of the sheet 5 by the inlet detection sensor 331, see step S20. When the amount of the difference is within a predetermined amount, the printing is continued, see step S21.

Meanwhile, when the amount of the difference exceeds a predetermined amount, it is assumed that the sheet size input by a user is the wrong size. Then, a blank space in the trailing edge of the sheet, which is determined based on the leading edge of the sheet and the sheet size, is changed into a blank space determined with respect to the sheet trailing edge position, which is determined based on the trailing edge detected by the inlet detection sensor 331, see step S22.

In this case, in consideration of a variation of the detecting position of the sheet trailing edge by the inlet detection sensor 331, the changed blank space is set larger than the blank space set by the leading edge position which is determined based on the stop position. For example, when the blank space set by the leading edge position is set to 5 mm, the blank space set with respect to the trailing edge position which is based on the detection by the inlet detection sensor 331 and is set to about 7 mm.

This makes it possible to determine a blank space in the trailing edge of the sheet correctly even when the sheet size is set wrong and prevents the problem of an image being formed outside of the sheet.

In the above described embodiments, an example is described in which the leading edge detection sensor 330 is disposed on the carriage to which the recording heads are mounted. However, it is possible for the leading edge of the sheet to be detected in a fixed position using line type recording heads.

Furthermore, in the above described embodiments, an electrostatic transport belt is used as a transport belt. However, it is possible to use a transport belt that adheres a sheet by creating a vacuum with air.

Numerous additional modifications and variations are possible in light of the above teachings. It is therefore to be understood that within the scope of the appended claims, the disclosure of the present invention may be practiced otherwise than as specifically described herein.

What is claimed is:

1. An image forming apparatus, comprising:

a recording head configured to eject liquid droplets to a recording medium, a transport belt that extends around at least two rollers and transports the recording medium to a position facing the recording head;

a pressure roller that corresponds to and is across the transport belt from an upstream side roller among the at least two rollers with respect to the recording medium transport direction and presses the recording medium against the transport belt;

an inlet detection sensor configured to detect the recording medium at a position located on an upstream side of a nip of the pressure roller and the transport belt with respect to the recording medium transport direction;

a leading edge detection sensor configured to detect a leading edge of the recording medium at a position located at a downstream side of the nip of the pressure roller and the transport belt with respect to the recording medium transport direction; and a control unit configured to control the leading edge of the recording medium to stop at a nip portion of the pressure roller and the transport belt based on a detection by the inlet detection sensor, wherein when the leading edge of the recording medium is not detected by the leading edge detection sensor, the leading edge position of the recording medium is determined based on a stop position of the recording medium at the nip portion of the pressure roller and the transport belt.

2. The image forming apparatus according to claim 1, wherein when the recording medium is not detected in a predetermined time by the leading edge detection sensor which moves to various positions to detect the leading edge of the recording medium, the leading edge position of the recording medium is determined based on the stop position at the nip portion of the pressure roller and the transport belt.

3. The image forming apparatus according to claim 1, wherein a blank space in a trailing edge of the recording medium is set based on the leading edge position and a length of the recording medium with respect to the recording medium transport direction.

4. The image forming apparatus according to claim 2, wherein a blank space in a trailing edge of the recording medium is set based on the leading edge position and a length of the recording medium with respect to the recording medium transport direction.

5. The image forming apparatus according to claim 3, wherein when a difference between a first leading edge position, which is set based on the leading edge position of the recording medium and the length of the recording medium, and a second leading edge position, which is obtained by detecting the trailing edge of the recording medium by the inlet detection sensor, exceeds a predetermined amount, a blank space in the trailing edge of the recording medium is changed into a blank space set based on the trailing edge position detected by the inlet detection sensor.

6. The image forming apparatus according to claim 4, wherein when a difference between a first leading edge position, which is set based on the leading edge position of the recording medium and the length of the recording medium, and a second leading edge position, which is obtained by detecting the trailing edge of the recording medium by the inlet detection sensor exceeds a predetermined amount, a blank space in the trailing edge of the recording medium is changed into a blank space set based on the trailing edge position detected by the inlet detection sensor.

7. An image forming method, comprising:

ejecting liquid droplets from a recording head to a recording medium;

pressing the recording medium against a transport belt, that extends around at least two rollers and transports the recording medium to a position facing the recording head, with a pressure roller that corresponds to and is across from the transport belt from an upstream side roller among the at least two rollers with respect to the recording medium transport direction;

detecting the recording medium with an inlet detection sensor located at a position located upstream of a nip of the pressure roller and the transport belt with respect to the recording medium transport direction;

detecting a leading edge of the recording medium with a leading edge detection sensor located at a position downstream of the nip of the pressure roller and the transport belt with respect to the recording medium transport direction;

controlling the leading edge of the recording medium to stop at a nip portion of the pressure roller and the transport belt based on a detection by the inlet detection sensor; and determining a leading edge position of the recording medium based on a stop position at the nip portion of the pressure roller and the transport belt, when the leading edge of the recording medium is not detected by the leading edge detection sensor.

8. The image forming method according to claim 7, further comprising:

determining the leading edge position of the recording medium based on the stop position at the nip portion of the pressure roller and the transport belt, when the recording medium is not detected in a predetermined time by the leading edge detection sensor which moves to various positions to detect the leading edge of the recording medium.

9. The image forming method according to claim 7, further comprising:

setting a blank space in a trailing edge of the recording medium based on the leading edge position and a length of the recording medium with respect to the recording medium transport direction.

10. The image forming method according to claim 8, further comprising:

setting a blank space in a trailing edge of the recording medium based on the leading edge position and a length of the recording medium with respect to the recording medium transport direction.

11. The image forming method according to claim 9, wherein when a difference between a first leading edge position, which is set based on the leading edge position of the recording medium and the length of the recording medium, and a second leading edge position, which is obtained by detecting the trailing edge of the recording medium by the inlet detection sensor, exceeds a predetermined amount, a blank space in the trailing edge of the recording medium is changed into a blank space set based on the trailing edge position detected by the inlet detection sensor.

12. The image forming method according to claim 10, wherein when a difference between a first leading edge position, which is set based on the leading edge position of the recording medium and the length of the recording medium, and a second leading edge position, which is obtained by detecting the trailing edge of the recording medium by the inlet detection sensor exceeds a predetermined amount, a blank space in the trailing edge of the recording medium is changed into a blank space set based on the trailing edge position detected by the inlet detection sensor.

13. The image forming apparatus according to claim 1, wherein the pressure roller is upstream of the recording head.

14. The image forming apparatus according to claim 1, wherein the leading edge detection sensor is in direct contact with a carriage that includes the recording head.

* * * * *